US005293296A

United States Patent [19]

Carl

[11] Patent Number: 5,293,296

[45] Date of Patent: Mar. 8, 1994

[54] EJECTING OUTLET AND ADAPTER

[76] Inventor: James C. Carl, Apt. 1C, 101 Highland Ave., Yonkers, N.Y. 10705

[21] Appl. No.: 829,288

[22] Filed: Feb. 3, 1992

[51] Int. Cl.[5] ..... H01H 77/00

[52] U.S. Cl. ..... 361/93

[58] Field of Search ..... 335/6; 337/198, 113; 361/93, 87

[56] References Cited

U.S. PATENT DOCUMENTS 4,345,223 8/1982 Chien-Chun ..... 335/6

4,514,715 4/1985 Chen ..... 337/113

*Primary Examiner*—A. D. Pellinen

*Assistant Examiner*—S. Jackson

[57] ABSTRACT

The ejecting electrical outlet has magnets positioned within the electrical receptacle. Springs are positioned between the magnets and are compressed when the prongs of a plug are entered into the outlet. The strength of a magnetic field generated by an overload electric current is sufficient to defeat the attractive forces between the magnet and to permit decompression of the spring and ejection of the plug from the electrical outlet.

1 Claim, 2 Drawing Sheets

EJECTING OUTLET AND ADAPTER

FIELD OF THE INVENTION

This invention relates to electric outlets; and, more particularly, it pertains to a safety electric outlet, wherein an electric overload will cause the electric plug to be ejected from the outlet.

BACKGROUND OF THE INVENTION

When there are electrical overloads in powerlines, there can be serious safety problems if electrical plugs are not removed from the electrical outlets. This is because there can be a surge of current through the plug and the electrical cord to the appliance. This can sometimes lead to fires and it may also lead to destruction or damage of the appliance itself.

Therefore, there is a need for an electrical outlet that will automatically eject an electric plug from an electrical outlet when there is an electrical overload. This is important to prevent fires, and also to prevent destruction or damage of electrical appliances.

SUMMARY OF THE INVENTION

The invention includes spring loaded electrical receptacles that are installed in a conventional electrical box. Magnets are used to hold the spring loaded receptacles in place. As the current through the powerline to the electrical box increases, so does the force of the magnetic field generated by the electric current. When an electrical overload occurs, the force of the magnetic field then becomes sufficiently great to repel the magnet that is holding the spring loaded receptacle in place and to cause it to be ejected from the electrical box. This causes a disconnection of the electric plug and the appliance and maintains a safe environment.

DETAILED DESCRIPTION OF THE INVENTION

Figure 1:
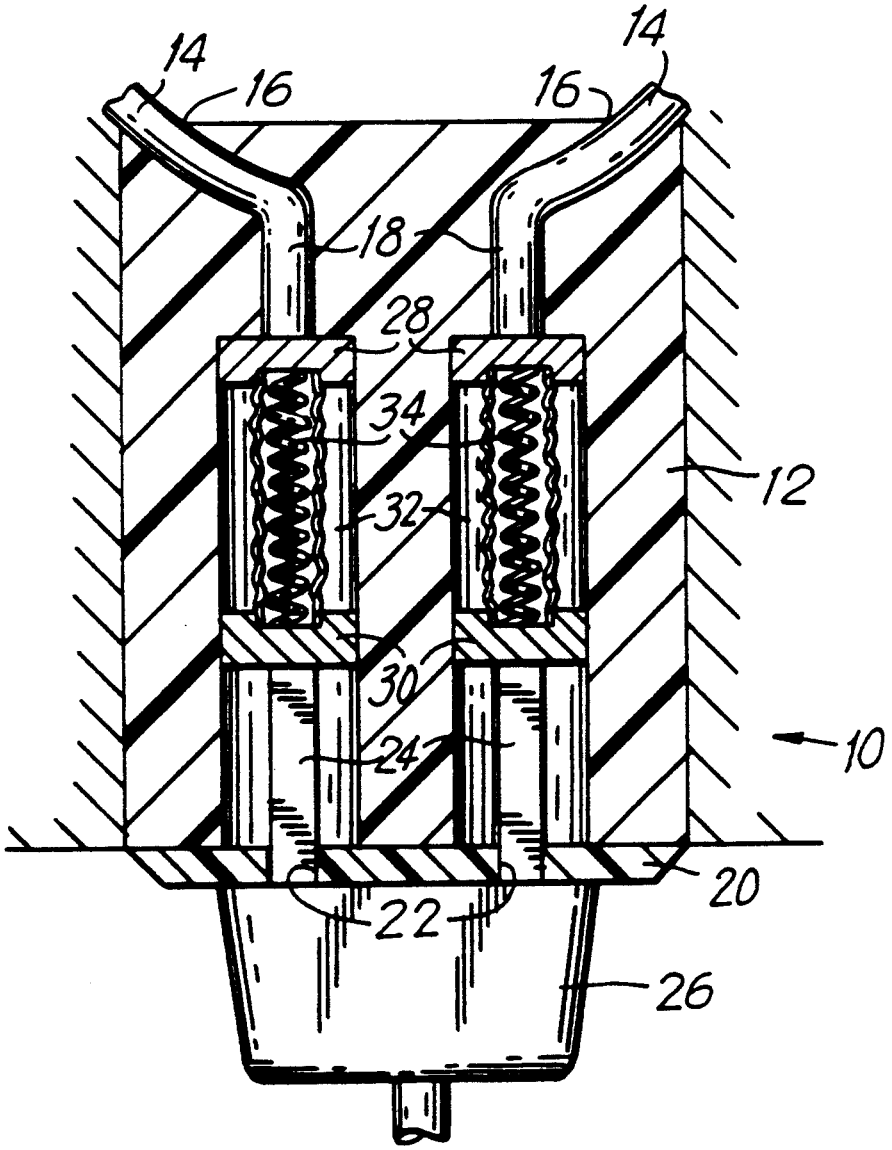
FIG. 1 is a top view, partially be broken away, showing the ejecting outlet and adapter.
Figure 2:
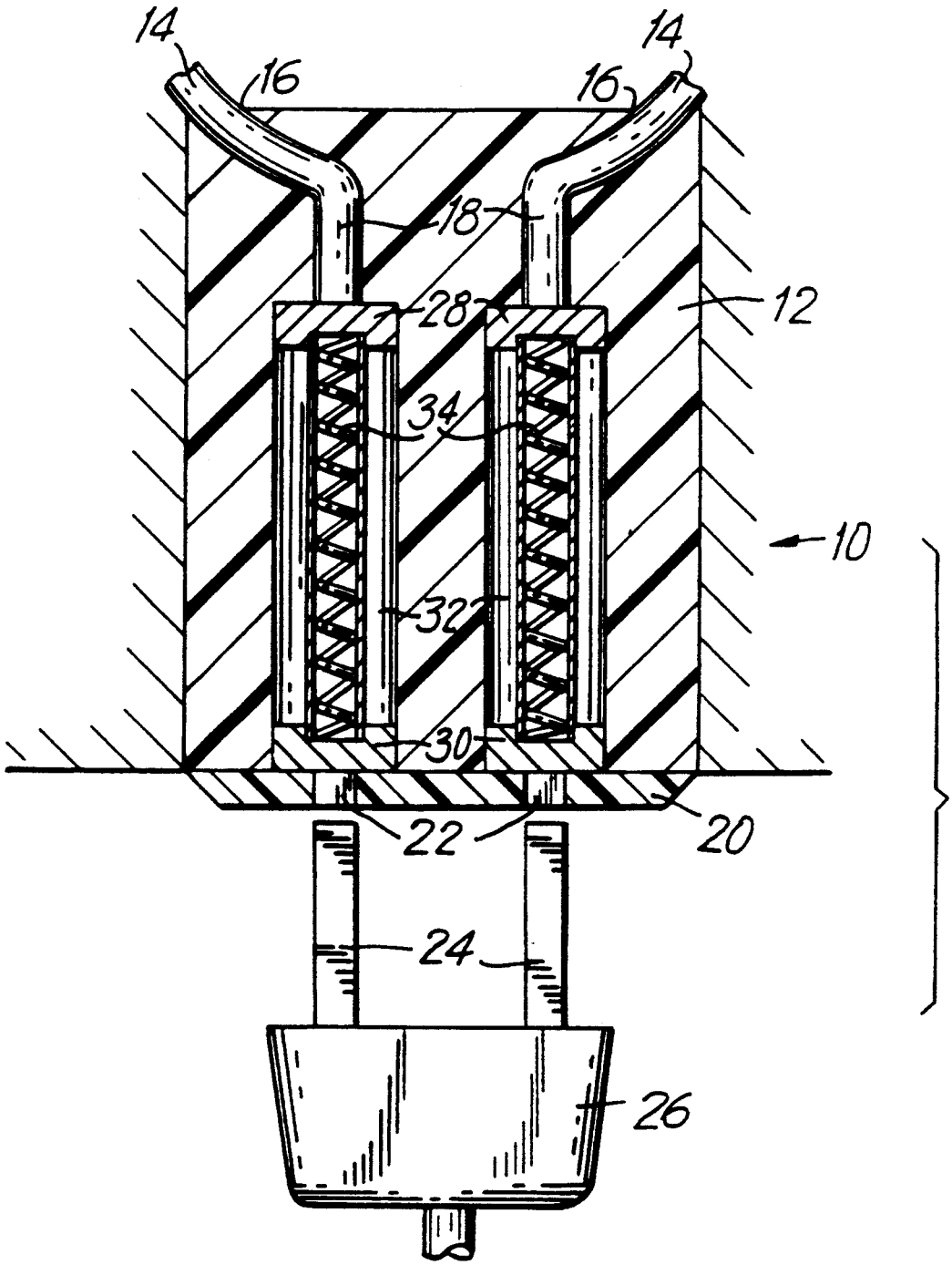
FIG. 2 is a top view of the ejecting outlet showing disconnection of the electric plug.

The ejecting outlet 10 of this invention may typically include an electrical receptacle box 12. The receptacle 12 may be of any desired shape, but may typically be made as a standard rectangular electrical receptacle. Further, it can be made of any suitable material, such as plastic, acrylic or any other desirable material. Appropriate apertures 16 would be made in the electrical receptacle 12 for the incoming powerlines 14. In this connection, the electrical receptacle 12 would be no different than any standard electrical receptacle box.

Included in the electrical receptacle 12 are conductors 18 which are connected to the respective powerlines 14. These conductors serve as a conduit to transmit the current from the powerlines to the appliance plug.

The front face 20 of the electrical socket 12 can be made in the usual fashion and would include elongate (or other suitably shaped) slots 22 for the prongs 24 of the plug 26. As shown in the drawings, the electrical receptacle has only one set of slots 22, but it can be appreciated that the invention can work for any number of sets of slots, such as a duplex outlet or a quad outlet.

Placed in close juxtaposition to the conductors 18 are a first set of magnets 28 (hereinafter "base magnetics").

The base magnetics 28 should be in touching relationship with the respective conductors 18, so as to permit the passage of electrical current from the conductors 18 to and through the base magnetics 28.

On the inside of the slots 22 are a second set of magnets 30 (hereinafter "outer magnets"). The outer magnets can be of any desired shape and may be in the same shape as the slots or the same shape and size as the prongs of a standard electrical plug. It is also possible that the outer magnets be of a reduced size, provided that they have sufficient surface area to contact the prongs of the standard electrical plug. Similarly, the base magnet 28 may be of any desired shape. In the preferred embodiment, the base magnet and the outer magnets are of the same shape and size, but it may be appreciated that they can be made of any shape and size and may even be made of different sizes and or shapes.

The magnets 28 and 30 are made as rings with a central opening 29 through which the hollow tubes 32 can pass.

Positioned between the base magnets 28 and the outer magnets 30 are hollow tubes 32 encapsulating springs 34. The outer shell of the hollow tubes 32 should be made of a material that permits the hollow tube to be compressed, such as aluminum or similar substances, as the springs 34 are compressed. As shown, the hollow tubes would be arranged in a plane parallel to the plane of the respective prong of the electric plug. In other words, the hollow tubes would be arranged perpendicularly to the plane of the slots 22

In use, the prongs 24 of a plug 26 of an electrical appliance would be inserted into the slots 22 of the electrical receptacle 12. When the prongs of the plug are thus inserted, they necessarily come up against the respective outer magnets 30. As the prongs are forced deeper into the electrical receptacle 12, the prongs push the outer magnets 30 away from the slots 22, thereby compressing the springs 34. When the prongs of the plug are completely inserted in the electrical receptacle, the attractive forces between the base magnets 28 and the outer magnets 30 hold the springs 34 in compression.

In this operating position, the current flows through the powerlines 14 to the conductors 18 and then through the base magnet 28, the tube 32 and then through the outer magnets 30 to the prongs 24 of the electrical plug 26 and then through to the electrical appliance in the standard fashion.

In a normal working condition, the magnetic force generated by the powerlines is not sufficient to upset the attractive forces between the base magnet 28 and the outer magnet 30. As the current through the powerlines increases, the force of the magnetic field generated by the powerline necessarily increases. At the point that an overload condition is created, the force of the magnetic field generated by the powerline becomes sufficient to disrupt the attractive forces between the base magnetic 28 and the outer magnet 30 and causes the base magnet 28 and the outer magnet 30 to repel each other. Then, the springs 34 become decompressed and serve to push the outer magnet 30 back toward the slot 22, thereby causing the prongs 24 of the electrical plug 26 to be ejected from the electrical receptacle 12.

In this fashion, the ejecting outlet 10 of the invention permits the flow of the electrical current to the electric plug of an electrical appliance in the normal fashion. When there is an electrical overload, however, the device works to eject the plug from the electrical receptacle, so as to avoid any fire or other damage and to prevent destruction or damage to the electrical appliance.

I claim:

1. An ejecting electrical outlet comprising:

an electrical receptacle box with apertures permitting the passage of prongs of an electrical plug and being connected to powerlines;

a first set of magnets positioned within said electrical receptacle and electrically connected to said powerlines;

a second set of magnets being disposed within said electrical receptacle and being displaceable from a position in juxtaposition to said apertures of said electrical receptacle to a position in close juxtaposition to said first set of magnets; and a biasing means between said first and second magnets;

wherein entry of said prongs of said electric plug into said apertures slots of said electrical receptacle causes said second set of magnets to be displaced towards said first set of magnets, and said first and second magnets having sufficient attractive forces to hold said prongs of said plug within said electrical receptacle; and wherein the strength of a magnetic field generated by an overload electric current in said powerlines is sufficient to defeat the attractive forces between said first and second magnets and to permit displacement of said second set of magnets toward said openings of said electrical receptacle.

* * * * *